US006935735B2

(12) United States Patent
Tanikawa et al.

(10) Patent No.: US 6,935,735 B2
(45) **Date of Patent: *Aug. 30, 2005**

(54) METHOD AND APPARATUS FOR RECORDING IMAGES ON BOTH SIDES OF A RECORDING SHEET

(75) Inventors: Kiyoshi Tanikawa, Kanagawa (JP); Aino Noguchi, Kanagawa (JP); Tadashi Saitoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 141 days.

This patent is subject to a terminal disclaimer.

(21) Appl. No.: 10/268,962

(22) Filed: Oct. 11, 2002

(65) Prior Publication Data

US 2003/0047272 A1 Mar. 13, 2003

Related U.S. Application Data

(63) Continuation of application No. 09/525,760, filed on Mar. 14, 2000, now Pat. No. 6,595,631.

(30) Foreign Application Priority Data

Mar. 24, 1999 (JP) ..... 11-080508

(51) Int. Cl.[7] ..... B41J 2/01

(52) U.S. Cl. ..... 347/103; 347/104; 399/302; 399/208; 355/202

(58) Field of Search ..... 347/103, 101

(56) References Cited

U.S. PATENT DOCUMENTS 4,538,156 A 8/1985 Durkee et al.
4,978,980 A * 12/1990 Noguchi et al. ..... 346/150
5,099,256 A 3/1992 Anderson
5,502,476 A 3/1996 Neal et al.
5,532,789 A 7/1996 Yaginuma et al.
6,439,713 B1 * 8/2002 Noguchi et al. ..... 347/103
6,595,631 B2 * 7/2003 Tanikawa et al. ..... 347/103

FOREIGN PATENT DOCUMENTS

| | | |
|---|---|---|
| JP | 32-004141 | 6/1957 |
| JP | 62-092849 | 4/1987 |
| JP | 402176777 | 7/1990 |
| JP | 5-200999 | 8/1993 |
| JP | 7-089067 | 4/1995 |
| JP | 10-058664 | 3/1998 |
| JP | 11-188858 | 7/1999 |
| JP | 11188858 A * | 7/1999 |

* cited by examiner

*Primary Examiner*—Stephen D. Meier
*Assistant Examiner*—Ly T Tran
(74) *Attorney, Agent, or Firm*—Oblon, Spivak, McClelland, Maier & Neustadt, P.C.

(57) ABSTRACT

Images formed by a liquid are transferred onto both sides of a sheet-like recording medium without the liquid running on or penetrating into the recording medium. A layer of absorbing powder is formed on an intermediate transfer member. The liquid is applied to the powder layer formed on the intermediate transfer member so as to form a first visible image. The first visible image is transferred onto the front side of the recording medium. Thereafter, another layer of the absorbing powder is formed on the intermediate transfer member, and the liquid is applied to the powder layer so as to form a second visible image. The second visible image is transferred onto the back side of the recording medium.

6 Claims, 6 Drawing Sheets

METHOD AND APPARATUS FOR RECORDING IMAGES ON BOTH SIDES OF A RECORDING SHEET

BACKGROUND OF THE INVENTION

1. Field of the Invention

The present invention generally relates to recording methods and apparatuses using an intermediate transfer medium and, more particularly, to a method and apparatus for forming images on the front side and back side of a sheet-like recording medium such as printing paper by forming images on an intermediate transfer medium by applying a liquid onto a layer of the intermediate transfer medium formed on an intermediate transfer member and transferring the thus-formed images to the front side and back side of the sheet-like recording medium.

2. Description of the Related Art

A recording method such as an inkjet recording method, in which droplets of a liquid containing a colorant are projected onto a recording medium in accordance with image signals, can be accomplished by an apparatus having a relatively simple, compact and light structure and a low noise. However, the inkjet recording method has a problem with respect to print quality in that the results of printing differ due to differences in the quality of printing papers such as synthetic paper, regular paper or inkjet paper. Particularly, when the printing is performed on regular paper with general use water soluble ink, there is a problem in that the resolution of a printed image is decreased due to running of ink on the printing paper or penetration of ink to the back side of the printing paper. Additionally, there is a problem in that the printed ink image may be smeared due to undried ink being touched when the printing paper having the ink image thereon is ejected from the inkjet apparatus. Further, since water soluble ink is normally used in the normal inkjet recording method, when the printing is performed on regular printing paper, printing cannot be performed on the back side of the printing paper after printing the front side of the printing paper due to running of ink on the printing paper or penetration of ink to the back side of the printing paper.

In order to eliminate the above-mentioned problems, intermediate transfer methods have been developed such as disclosed in U.S. Pat. No. 4,538,156 and No. 5,099,256. In the intermediate transfer methods, an ink image is formed on an intermediate transfer member according to the inkjet recording method, and, thereafter, the ink image is transferred onto a recording medium such as printing paper. According to the intermediate transfer method, the recording head can be located remote from the printing paper, which prevents clogging of the nozzles of the recording head due to adhesion of paper dust. However, the intermediate transfer method has problems in that, when droplets of ink are provided on the intermediate transfer member, the droplets may improperly spread or move on the intermediate transfer member. Additionally, if color ink is used, mixing of colors may occur which causes an image quality to deteriorate. Further, there are issues to be solved such as the transferring efficiency to a recording medium such as paper or the quality of the transferred image on the recording medium. For example, running of ink or penetration of ink to the back side of the printing paper is one of the issues to be solved.

In order to solve the above-mentioned problems, Japanese Laid-Open Patent Application No. 62-92849 discloses an improved intermediate transfer method in which the droplets of ink on the intermediate transfer member are dehydrated so as to transfer the condensed ink droplets to a recording medium such as paper. This method is advantageous in forming a clear image. However, the condensation of ink requires a considerable time interval and amount of heat energy, and also requires means for preventing scattering of water vapor from the ink droplets. Accordingly, this method cannot satisfy the demand for high-speed printing for both sides of a recording medium, the demand for energy saving and the demand for a further increase in the resolution of the image.

Japanese Laid-Open Patent Application No. 5-200999 discloses an intermediate transfer method in which droplets of ink are applied to a water absorbing layer on the intermediate transfer member so as to dehydrate the droplets, and the dehydrated droplets are transferred to printing paper. The water absorbing layer is made of a film or fibrous material which swells by absorbing water at a low temperature and releases the absorbed water due to a phase change at a high temperature. That is, in this method, water or solution in the droplets of ink is removed by the water absorbing layer, and the condensed ink is transferred onto the printing paper. Accordingly, this method is advantageous in forming a clear image. However, similar to the method disclosed in Japanese Laid-Open Patent Application No. 62-92849, the condensation of ink requires a considerable time interval and a considerable amount of heat energy, and also requires means for preventing scattering of water vapor from the ink droplets. Additionally, this method requires means for removing the water or solution from the water absorbing layer. Accordingly, this method cannot satisfy the demand for high speed printing for both sides of a recording medium, the demand for energy saving, the demand for a further increase in the resolution of the image and the demand for reducing the size and weight of the apparatus.

Japanese Laid-Open Patent Application No. 7-89067 discloses an inkjet recording technique in which droplets of ink are provided on a surface active agent applied on the intermediate transfer member so as to form an ink image on the surface active agent so that the thus-formed ink image is transferred onto a recording medium. Generally, the surface active agent has a function to reduce surface tension of a liquid or a solution. Thus, when a droplet of ink whose major component is water is provided onto the surface active agent by an inkjet recording method, the surface tension of the droplet of ink is reduced. The reduction in the surface tension results in the spreading of the droplet of ink. Accordingly, the diameter of the droplet of ink on the surface active agent is larger than the diameter of the droplet of ink projected by the inkjet nozzle. Thereby, it is difficult to achieve a high-resolution, sharp image by the technique using the surface active agent. Additionally, since the droplet is transferred onto the recording medium such as paper together with the surface active agent, the droplet of ink and the surface active agent are absorbed by the recording medium, which results in the running and penetration of ink. Thus, the technique using the surface active agent cannot be used for both-side printing.

Additionally, Japanese Laid-Open Patent Application No. 10-58664 discloses a method in which droplets of ink containing quarternary ammonium salt are provided onto an anionic ion exchanging resin layer on the intermediate transfer member so as to transfer the droplets of ink after the droplets are subjected to a chemical reaction during the conveyance of the droplets by the intermediate transfer member. This method is advantageous in improving the transfer efficiency. However, since the nature of the colorant contained in the ink is changed by the ion exchanging resin layer, the color of the ink may be slightly changed. Generally, the ion exchanging resin layer does not have a function to absorb water contained in a droplet of ink. Accordingly, the droplet of ink applied to the ion exchanging resin layer is subjected to a change in its nature, but concentration of ink in the droplet does not change. That is, the droplet of ink is transferred onto a recording medium without change in the concentration of ink. Thus, running of ink, color mixing or penetration of ink to back surface occurs in the transferred ink image. Additionally, when the ion exchanging resin layer is heated so as to restore the function of the ion exchanging resin layer, an ammonium gas is generated. Accordingly, the stench of the ammonium gas causes pollution of air. Further, there is a problem in that a maintenance operation must be frequently performed so as to restore the ion exchanging resin layer. Further, this method cannot satisfy the demand for high-speed printing for both sides of a recording medium, the demand for energy saving, the demand for a further increase in the resolution of the image and the demand for reducing the size and weight of the apparatus.

In order to solve the above-mentioned problems, Japanese Laid-Open Patent Application No. 11-188858 suggests an intermediate transfer method using a polymeric powder being applied onto an intermediate transfer member, the polymeric powder having a liquid absorbing characteristic. In this method, a layer of the polymeric powder is formed on an intermediate transfer member before a liquid is provided onto the intermediate transfer member so as to form an image. The polymeric powder dissolves in the liquid or swells by absorbing the liquid, and increases the viscosity of the liquid. Additionally, the layer of the polymeric powder layer can be easily removed from the intermediate transfer member. However, this patent document does not refer to a method for recording images on both sides of a sheet-like recording medium such as printing paper without deterioration of the image quality due to running or penetration of ink.

SUMMARY OF THE INVENTION

It is a general object of the present invention to provide an improved and useful intermediate transfer recording method in which the above-mentioned problems are eliminated.

A more specific object of the present invention is to provide an intermediate transfer recording method which can record images on both sides of a sheet-like recording medium while preventing the image formed on one of the front and back sides from being influenced by the image formed on the other side.

In order to achieve the above-mentioned objects, there is provided according to one aspect of the present invention a method for recording images on a sheet-like recording medium having a first side and a second side opposite to the first side, the method comprising the steps of:

- forming a layer of a material on an intermediate transfer member;
- applying a liquid to the layer formed on the intermediate transfer member so as to form a first visible image on the layer, a viscosity of the liquid being increased by the material forming the layer on the intermediate transfer member;
- transferring the first visible image onto the first side of the recording medium;
- forming another layer of the material on the intermediate transfer member;
- applying the liquid to the layer formed on the intermediate transfer member so as to form a second visible image on the layer; and
- transferring the second visible image onto the second side of the recording medium.

According to the present invention, visible images are provided on both the first and second sides of the recording medium. The formation of the visible images are performed by using the material which increases the viscosity of the liquid such as ink for forming the visible image. Accordingly, when the liquid is transferred onto the recording medium such as printing paper, the liquid does not run on or penetrate into the recording medium due to the increased viscosity. Thus, the visible images can be formed on both the first side and the second side of the recording medium while the visible image on one side is not influenced by the visible image on the other side.

In the present invention, the material forming the layer on the intermediate transfer member may have a liquid absorbing property, and the material may be in the form of powder.

When the layer is formed by the powder, only the portion of the layer wetted by the liquid absorbs the liquid. Since the cohesive force of the wetted powder is not so large as that of a solid layer, the portion of the layer formed by the wetted powder can be locally disengaged from the remaining portion of the layer. Thereby, the visible image formed by the liquid wetting the powder can be easily removed from the intermediate transfer belt, and is transferred onto the recording medium without deformation of the visible image.

The material may be a mixture of a plurality of kinds of powders. Additionally, the plurality of kinds of powders may include a first powder and a second powder, the first powder increasing the viscosity of the liquid, the second powder increasing an adhesive force of the image formed by the liquid.

Accordingly, the first powder serves to prevent the liquid from running on or penetrating into the recording medium, and the second powder serves to improve the adhesion of the visible image to the recording medium.

Additionally, according to another aspect of the present invention, a recording apparatus performing the above-mentioned method is provided.

According to one embodiment of the present invention, a recording apparatus records an image on a sheet-like recording medium having a first side and a second side opposite to the first side, the recording apparatus comprising:

- an intermediate transfer belt carrying an image to be transferred onto the recording medium;
- a liquid ejecting head ejecting droplets of a liquid toward the intermediate transfer belt;
- an applicator applying a powder to a surface of the intermediate transfer belt so as to form a layer of the powder on the surface of the intermediate transfer belt, the powder being applied on the surface of the intermediate transfer belt prior to the application of the droplets of the liquid by the liquid ejecting head so that a visible image is formed by the droplets of the liquid on the layer of the powder, the powder absorbing the liquid so as to increase a viscosity of the droplets applied to the layer of the powder;
- a transfer roller pressing the visible image on the intermediate transfer belt against the recording medium so as to transfer the visible image onto the recording medium;
- a feeding mechanism feeding the recording medium so that the recording medium passes through a transferring position between the transfer roller and the intermediate transfer belt, the feeding mechanism including a first detector and a second detector, the first detector detecting an absence of an image on the first side of the recording medium and the second detector detecting an absence of an image on the second side of the recording medium, the feeding mechanism also including a switching mechanism to change a direction of feed of the recording medium so that the recording medium which has been passed through the transferring position can be returned to a position on the upstream side of the transfer roller and can be passed through the transferring position again, the recording medium being turned over while the recording medium is being returned to the position on the upstream side of the transfer roller; and a control unit controlling operations of the intermediate transfer belt, the recording head and the switching mechanism so that the visible image is transferred onto at least one of the first and second sides of the recording medium based on outputs of the first and second detectors.

Other objects, features and advantages of the present invention will become more apparent from the following detailed description when read in conjunction with the accompanying drawings.

DETAILED DESCRIPTION OF THE PREFERRED EMBODIMENTS

Figure 1:
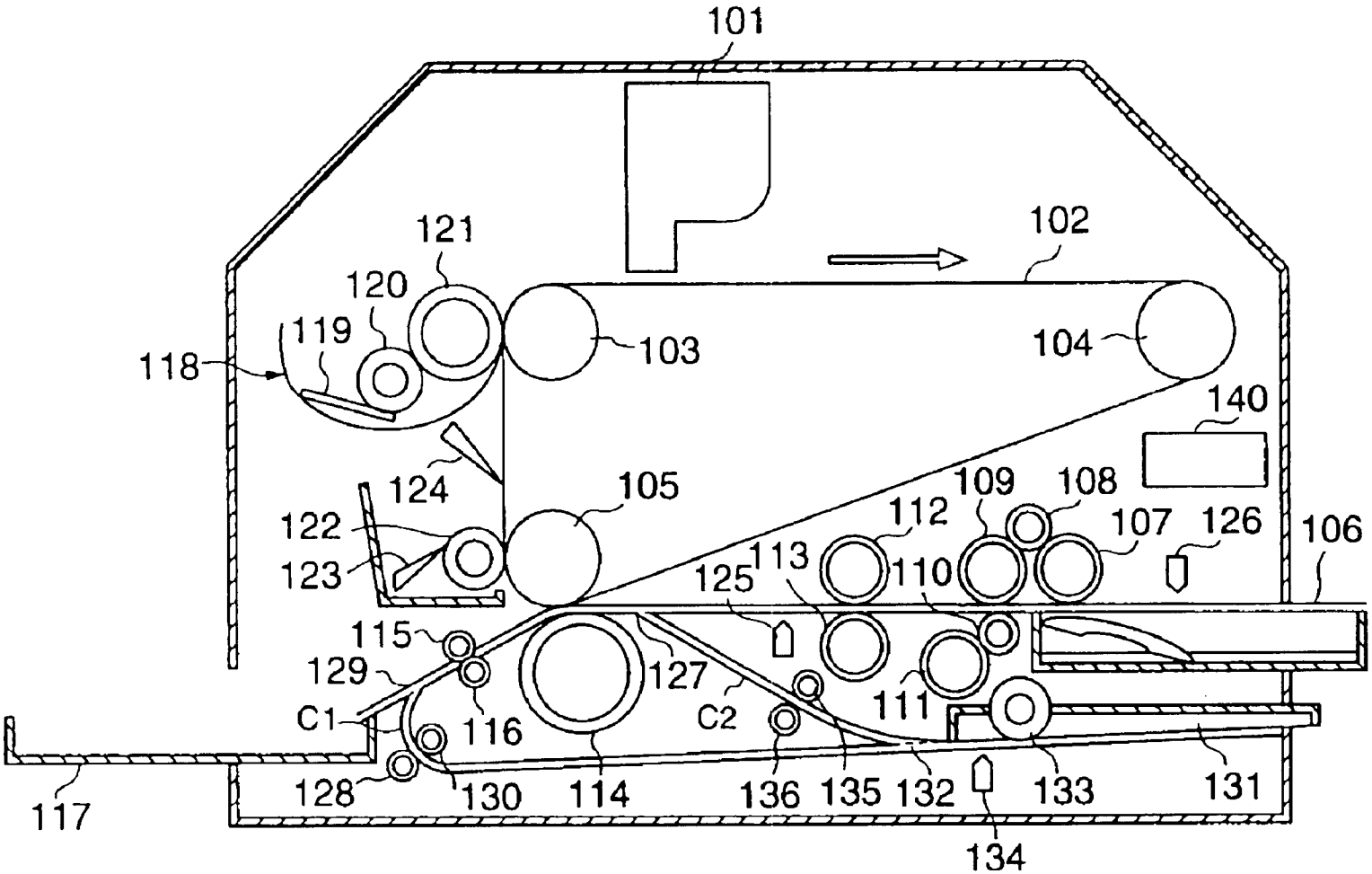
FIG. 1 is a schematic illustration of an inkjet recording apparatus according to a first embodiment of the present invention.

A description will now be given of a first embodiment of the present invention. FIG. 1 is a schematic illustration of an inkjet recording apparatus according to the first embodiment of the present invention.

The inkjet recording apparatus shown in FIG. 1 records an ink image on a sheet-like recording medium such as printing paper by using an intermediate transfer member such as an intermediate transfer belt 102. The ink image is first formed on the intermediate transfer belt 102 by projecting ink droplets onto the intermediate transfer belt 102, and, thereafter, transferred onto the printing paper.

In the inkjet recording apparatus according to the first embodiment of the present invention, an intermediate transfer medium (hereinafter referred to as setting agent) is applied onto the surface of the intermediate transfer belt 102 before the ink droplets are projected from an inkjet recording head 101 so as to form a layer of the setting agent on the surface of the intermediate transfer belt 102. More specifically, the setting agent stored in a setting agent container 118 is applied onto the surface of the intermediate transfer belt 102 via an application assistance roller 120 and a application roller 121 while the amount of setting agent to be applied is controlled by an application amount controlling blade 119.

After the layer of the setting agent is formed on the intermediate transfer belt 102, ink droplets are projected from the inkjet recording head 101 in accordance with image signals. The intermediate transfer belt 102 continuously cycles by being engaged with rollers 103, 104 and 105 so as to carry the layer of the setting agent applied on the intermediate transfer belt 102 and the printed image formed on the layer of the setting agent by the ink droplets. The setting agent and the ink image on the intermediate transfer belt 102 are transferred by being pressed by a transfer roller 114 onto a surface of a recording medium supplied from a paper supplying tray 106 and conveyed by paper feed rollers 107, 108, 109, 110 and 111 and register rollers 112 and 113.

Thereafter, the recording medium having the ink image and the setting agent corresponding to the ink image is ejected onto an eject tray 117 by a pair of eject rollers 115 and 116. After the ink image and the setting agent corresponding to the ink image formed on the intermediate transfer belt 102 are transferred onto the recording medium, the setting agent remaining on the surface of the intermediate transfer belt 102 is removed, if necessary, by a cleaning roller 122 and cleaning blades 123 and 124. Then, additional setting agent is applied to the surface of the intermediate transfer belt 102 so as to prepare for a subsequent recording process.

It should be noted that the operation of each part of the inkjet recording apparatus shown in FIG. 1 is controlled by a control unit 140. The control unit 140 has a known structure comprising a circuit board and a microprocessor and a memory mounted on the circuit board, and a description thereof will be omitted.

A description will now be given of the properties of the setting agent used in the present embodiment. The setting agent has a swelling property with respect to absorbing water contained in the ink droplets applied thereon. Additionally, a part of the setting agent dissolves into the liquid of the ink droplets. Thereby, the viscosity of the ink droplets is increased, which prevents mixing of colors in the ink image. Since the pigment or die component of the ink droplets is physically or chemically absorbed in or coupled to the setting agent and a weak bridge coupling occurs between the molecules of the setting agent, the pigment or die component is condensed in the ink droplets or the viscosity of the setting agent is increased.

The setting agent according to the present embodiment is formed of a powder having a diameter of 0.05 micrometers ($\mu$m) to 50 micrometers, preferably 0.1 micrometers to 10 micrometers. It is known that the cohesive force of a powder is weak. Accordingly, when the ink droplets are applied to the layer of the powder applied on the intermediate transfer belt, unevenness is generated between an image portion which is formed by the application of the ink droplets and a non-image portion corresponding to a portion to which the ink droplets are not applied. The unevenness is in the order of several micrometers, which results in an extremely sharp image.

It should be noted that if the diameter of the powder is less than 0.05 micrometers, the cohesive force between the powder particles is extremely strong, and a lump of powder may be formed. In such a case, it is difficult to obtain a sharp image. On the other hand, if the diameter of the powder is greater than 50 micrometers, the cohesive force of the powder becomes small but the adhesive force of the powder is decreased, which results in deterioration of the image.

After the image formed by the ink droplets applied to the intermediate transfer belt and the setting agent corresponding to the image is transferred onto the recording paper, the pigment or die component of the ink droplets is condensed by the setting agent and the adhesive force of the ink droplets is increase due to an increase in the viscosity of the ink droplets. Accordingly, a high-resolution image can be obtained due to a sharp separation between the image portion and the non-image portion. Especially, if the recording medium is made of paper, the ink droplets do not run on or penetrate into the paper since the ink droplets are condensed and their viscosity is increased. Additionally, since the pigment or die component adheres to the powder, the pigment or die component does not run or penetrate into the paper. Thereby, the image transferred onto the paper has an extremely high resolution and a good image quality. Thus, the use of the above-mentioned powder allows the printing of ink images on both sides of the recording paper.

Additionally, a better image quality can be obtained by mixing a plurality of kinds of powders having different properties. That is, the powders having different dissolution or swelling properties, different viscosity increasing properties, different exfoliation properties and different diameters may be mixed with each other so as to produce a mixture of powder which provides a good image quality.

As for the mixture of powders, for example, a mixture of water absorbing polymer powders having different water absorbing properties, a mixture of water absorbing powders having different diameters or a mixture of a moisturizing adhesive agent which provides adhesion in the presence of water and a water absorbing powder may be preferably used. More specifically, more than two kinds of water absorbing polymer powders having different properties due to the difference in the magnitude of cross-linking may be preferably used. For example, generally, when the magnitude of cross-linking is low, the water absorbing polymer absorbs less water but has a high viscosity. When the magnitude of cross-linking is appropriate, the water absorbing polymer provides a swelling property due to reduction in the water absorbing property, and, thereby, the water absorbing polymer changes to a gel. When the magnitude of cross-linking is high, the water absorbing polymer provides a high water absorbing property and has a low viscosity, and becomes merely a hydrophillic polymer. Accordingly, if the water absorbing polymer having the magnitude of cross-linking which provides a high water absorbing property and the water absorbing polymer having the magnitude of cross-linking which provides a high viscosity are mixed with each other, an image having an excellent image quality can be formed on the recording paper since the condensation of the ink droplets are performed by the water absorbing polymer having the high magnitude of cross-linking and the increase in the transfer efficiency of the ink image to the recording paper is performed by the water absorbing polymer having the low magnitude of cross-linking. It should noted that the relationship between the magnitude of cross-linking and each of the water absorbing property and the viscosity depends on the kinds of water absorbing polymers. However, water absorbing polymers generally satisfy the above-mentioned relationship.

Japanese Laid-Open Patent Application No. 32-4141 discloses that a polymer having a high viscosity increasing property can be obtained by adding 0.5% acryl sorbitol as a cross-linking agent when an acrylic acid is copolymerized in a solution, and a polymer having a swelling property as high as 600 times can be obtained by adding 1.0% acryl sorbitol as a cross-linking agent. In the present invention, the concentration of the cross-linking agent is in the range from 0.0005 mol % to 2.0 mol %, preferably in the range from 0.001 mol % to 1.0 mol %. As to the mixing ratio, it is preferable that the powder having a high magnitude of cross-linking is in the range of 1 weight percent (wt %) to 20 wt %, preferably 2 wt % to 10 wt %. If the concentration of the cross-linking agent is less than 0.0005 mol %, the effect of cross-linking cannot be sufficiently exhibited, and, thus, the image quality deteriorates. On the other hand, if the concentration of the cross-linking agent is greater than 2.0 mol %, the effect of cross-linking cannot be sufficiently exhibited, and, thus, the image quality deteriorates. With respect to the mixing ratio of the powders, if the concentration of the powder having a high magnitude of cross-linking is less than 1 wt %, the image quality deteriorates since a sufficient cross-linking effect cannot be exhibited. On the other hand, if the powder having the high magnitude of cross-linking is greater than 20 wt %, the magnitude of swelling becomes undesirably high. Thus, the adhesion force of the ink droplet is decreased, and the image quality deteriorates.

Generally, fluidity of a powder is dependent on the diameter of the powder, interaction between grains of the powder, and structure of the assembly of the powder. If the powder is solely a fine powder, the powder aggregates due to its interaction between individual powder grains, and the fluidity of the powder is decreased. On the other hand, if the powder is solely a coarse powder, there is less interaction between individual powder grains. Thus, the voids of the powder are increased and the powder has a high fluidity. Accordingly, if powders having different diameters are mixed, the fluidity of the mixed powder can be adjusted, and the mixed powder can be applied onto the intermediate transfer belt with a uniform thickness. When the ink image is formed by applying ink droplets onto the layer of the mixed powder having a uniform thickness, the ink image has a further improved quality with a higher resolution.

Comparison is made between a fine powder of the water absorbing polymer and a course powder of the water absorbing polymer. In the comparison, ink droplets are applied by an inkjet recording method to both the fine powder of the water absorbing polymer and the coarse powder of the water absorbing polymer. That is, the same amount of ink is applied to each of the fine powder and the coarse powder of the water absorbing polymer. The water absorbing property of the fine powder saturates in a short time and the powder dissolves into the water, which results in an increase in the viscosity of the ink droplet. On the other hand, the coarse powder of the water absorbing polymer merely swells, and the adhesive force thereof is not greatly increased. Accordingly, when powders having different diameters are mixed, the mixture has an improved ink droplet holding property and adhesion property, which results in a superior transfer efficiency.

In the present invention, the diameter of the coarse powder is 1.5 times to 100 times the diameter of the fine powder, preferably 2 times to 50 times the diameter of the fine powder. If the diameter of the coarse powder is less than 1.5 times the diameter of the fine powder, a superior image quality cannot be obtained since there is no significant difference in the properties of the powders. On the other hand, if the diameter of the coarse powder is greater than 100 times the diameter of the fine powder, a superior image quality cannot be obtained since a smoothness of the surface of the transferred image cannot be maintained. With respect to the mixing ratio, the concentration of the coarse powder is in the range of 1 wt % to 20 wt %, preferably in the range of 2 wt % to 10 wt %. If the concentration of the coarse powder is less than 1 wt %, the image quality deteriorates since the effect of diameter of the coarse powder cannot be sufficiently exhibited. On the other hand, if the concentration of the coarse powder is greater than 20 wt %, the magnitude of swelling becomes undesirably high. Thus, the adhesion force of the ink droplets is decreased, and the image quality deteriorates.

If the powder mixture includes a water absorbing polymer and a remoisturizing adhesive which exhibits an adhesive force in the presence of water, the water absorbing polymer serves to condense the ink droplet applied according to the inkjet recording method and the remoisturizing adhesive serves to increase the adhesive force when the water absorbing polymer, which holds the condensed ink droplets and the image, is transferred to and fixed on the recording paper. Accordingly, when the transfer to the recording paper is performed, a superior transfer and fixing efficiency can be provided by the water absorbing polymer and the remoisturizing adhesive. Thus, the resolution of the image is further increased. The ratio of mixing of the remoisturizing adhesive is preferably in the range of 1 wt % to 20 wt %, more preferably in the range of 2 wt % to 10 wt %. If the remoisturizing adhesive contained is less than 1 wt %, the function of the remoisturizing adhesive cannot be sufficiently exhibited since the most of water contained in the ink droplets is absorbed by the water absorbing polymer. Thus, the transfer and fixing efficiency deteriorates, and a superior image quality cannot be obtained. On the other hand, if the remoisturizing adhesive contained is more than 20 wt %, the drying characteristic deteriorates due to moisturization of the remoisturizing adhesive being large. Thus, a superior image quality cannot be obtained.

The remoisturizing adhesive is an adhesive made by drying a water soluble polymer and is dried in its normal state. The remoisturizing adhesive provides an adhesive force when wetted by water or steam before use due to redissolution of the water soluble polymer by the water. Among the water soluble polymers that may be used are casein, starch, polyvinyl alcohol, polyvinyl ether and polyacryl acid salt.

In the present invention, the mixture of powders, which can be dissolved or swollen by a liquid so as to increase the viscosity of the liquid and can form a layer of powder removable from the intermediate transfer belt, preferably comprises water soluble polymers and water absorbing polymers when the liquid is a water based liquid. If the liquid is an oil based liquid, oil soluble polymers and oil absorbing polymers are preferable. Specifically, the following are examples of water absorbing polymers when the liquid is a water base liquid: poly(alkyl oxide) such as poly(ethylene oxide); poly(vinyl pyrrolidon); poly(vinyl alcohol); poly(vinyl butyral); poly(acrylic acid); poly(salt of acrylic acid); copolymer of isobutylene and maleic acid; poly(acryl amide); poly(propylene glycol); glue; gelatin; casein; alubmin; gum arabic; alginic acid; sodium alginate; methyl cellulose; carboxymethyl cellulose; hydroxyethyl cellulose; poly(vinyl ether): poly(vinyl methyl ether); poly (ethylene glycol); glucose; xylose; sculose; maltose; arabinose; α-cyclodextrin; starch and the like; and copolymers, graft polymers and cross-linking polymers of the foregoing. The water absorbing polymer usable in the present invention is not limited to the above, and other polymers may be usable.

The followings are examples of the oil soluble polymers and the oil absorbing polymers that are used when the liquid is an oil base liquid: petroleum base polymer, rosin denaturated phenol polymer; and alkyd polymer. However, the oil soluble polymer and the oil absorbing polymer usable in the present invention are not limited to the above, and other polymers may be usable.

A description will now be given of properties of the material of the intermediate transfer belt. A rubber material is suitable for the intermediate transfer belt. That is, the material suitable for the intermediate transfer belt facilitates the transfer of the mixture of powders, which holds the ink image formed by application of ink droplets in accordance with image signals, onto the recording paper. The followings are examples of the rubber material: silicon rubber; fluorosilicon rubber; phenylsilicon rubber; fluorocarbon rubber; chloroprene rubber; nitrile rubber; ethylene propylene rubber; natural rubber; styrene rubber; isoprene rubber; butadiene rubber; ethylene/propylene/butadiene polymer; nitrile butadiene rubber. Especially, cylicon rubber, fluoro silicon rubber, phenylsilicon rubber, fluorocarbon rubber and chloroprene rubber are preferred for use.

A description will now be given of the properties of the recording medium suitable for the recording method according to the present invention. The followings are examples suitable for the recording medium: a recording medium having an image forming surface made of a paper layer of which the main component is cellulose fiber; a recording medium having an image forming surface made of a layer having a partial cross-linking structure containing a water soluble material as a main component, such as poly(ethylene glycol) or polymer of acrylic acid; and a recording medium used for an inkjet recording medium. More specifically, the following materials can be used: a commercially available printing paper made from cellulose fiber as a main component, such as copy paper, regular paper, recording paper or plastic film used for an overhead projector (OHP); a sheet-like material having a paper layer on which an image is formed, the paper layer comprising cellulose fiber as a main component; a plastic film, glass, wood, non-woven cloth, cloth or a metal plate having a water swelling layer such as a layer having a partial cross-linking structure such as a polymer of acrylic acid or a polymer of methacrylic acid.

The mixture of powders as the setting agent according to the present invention can be applied to the intermediate transfer belt by the following methods: applying an electrostatic attracting force by electrically charging the mixture of powders and electrically charging the surface of the intermediate transfer belt; rubbing the mixture of powders against the surface of the intermediate transfer belt by contacting a roller, a blade or a plate having a flat surface made of plastic, glass, metal or ceramics; rubbing the mixture of powders against the surface of the intermediate transfer belt using a plate-like member formed of a porous material such as sponge, paper, felt cloth or rubber which carries the mixture of powder; rubbing the mixture of powder against the surface of the intermediate transfer belt by contacting a roller made of a porous material which roller carries the mixture of powders; rubbing the mixture of powders against the surface of the intermediate transfer belt by contacting a brush which carries the mixture of powders; spraying the mixture of powders toward the surface of the intermediate transfer belt using a powder spray method.

According to the transfer means of the present invention, an image formed on the surface of the layer of the mixture of powders is brought into contact with the surface of the recording paper by being heated and pressed by a transfer pressurizing roller 114 so that the image and the mixture of the powders forming the image are transferred onto the recording paper. The followings explains a method of pressing or heating and pressing the mixture of powders and a member used for the method: pressing or heating and pressing the intermediate transfer belt against the recording medium by using a roller, a blade or a plate having a flat surface which is made of plastic, glass, metal or ceramics; pressing or heating and pressing the intermediate transfer belt against the recording medium by using a plate-like member or a roller which is made of a porous material such as sponge, paper, felt, cloth or rubber. When a roller is used for heating and pressing, the heating process can be performed by a heater built into the roller. When a plate-like member is used, a heating element such as a resistance heating element or a radiation heating element may provided near the plate-like member. When the pressing process is performed while heating, the water component contained in the recording liquid (ink droplets) can be forcibly and quickly evaporated, which increases the recording speed.

A description will now be given of modes of operation of the inkjet recording apparatus performing the method for recording on both sides of a recording medium according to the present invention.

<First Mode>

In the first mode, which may be referred to as a single side mode, a printing operation is performed on a single side of the recording medium having no image formed on the front and back sides thereof. The operation in the single side mode is the same as the previously mentioned basic operation of the inkjet recording apparatus shown in FIG. 1.

In the single side mode, the setting agent (not shown in the figure) is applied onto the surface of the intermediate transfer belt 102. After the layer of the setting agent is formed on the intermediate transfer belt 102, ink droplets are projected from the inkjet recording head 101 in accordance with image signals. The intermediate transfer belt 102 continuously cycles by being engaged with rollers 103, 104 and 105 so as to carry the layer of the setting agent applied on the intermediate transfer belt 102 and the printed image formed on the layer of the setting agent by the ink droplets. The setting agent and the ink image on the intermediate transfer belt 102 are transferred by being pressed by the transfer roller 114 onto a surface of a recording medium supplied from a paper supplying tray 106 and conveyed by paper feed rollers 107, 108, 109, 110 and 111 and register rollers 112 and 113. Thereafter, the recording medium having the ink image and the setting agent corresponding to the ink image is ejected onto an eject tray 117 by the pair of eject rollers 115 and 116. According to the above-mentioned operation, an image is formed on one side of the recording medium.

It should be noted that, in the first mode and also in other modes described below, the presence of a previously formed image on the front side of the recording medium accommodated in the paper supply tray 106 is detected by a detector 126. Each of switch levers 127, 129 and 132 is always set to a normal position in the single side mode, as described later with reference to FIGS. 6, 7 and 8. Even if one of the switches 127, 129 and 132 is in a change position, that switch is returned to the normal position immediately after the recording medium passes by that switch. Additionally, as described later with reference to FIGS. 2, 3, 4 and 5, the selection of one of the single-side mode, both-side mode 1, both-side mode 2 and both-side mode 3 is performed based on the detection of the presence of an image on the recording medium accommodated in the paper supply tray 106 by an image detector 125 located in the middle of the conveyor path and the detector 126 located above the paper supply tray 106.

The switch levers 127, 129 and 132 serve as means for separating the recording media requiring formation of images on both sides from the recording media requiring formation of images on a single side. The switch levers 127, 129 and 132 also serve as means for changing the direction of feed of the recording medium depending on whether images are to be formed on a single side or both sides.

<Second Mode>

In the second mode, which is referred to as a both-side mode 1, images are formed on both sides of the recording medium in a case in which no image has previous been formed on both the front and back sides of the recording medium, that is, in a case in which the recording medium is blank on both sides.

First, it is detected and confirmed that the front and back sides of the recording medium accommodated in the paper supply tray 106 do not have images. Then, an image is formed on the layer of the setting agent applied on the intermediate transfer belt 102 by projecting ink droplets from the inkjet recording head 101. The intermediate transfer belt continuously cycles by being engaged with the rollers 103, 104 and 105. The recording medium is fed from the paper supply tray 106 by the paper supply rollers 107, 108, 109, 110 and 111 and register rollers 112 and 113 so that the ink image formed by the ink droplets and the setting agent is transferred by the transfer roller 114. During the feed of the recording medium, the image detector 125 detects whether a previously formed image is present on the back side of the recording medium, and the result of detection is fed back to the control unit 140 so as to change the switch lever 129 to a switch state (refer to the switch lever 129 in FIG. 7B). That is, when the switch lever 129 is rendered to be in the switch state, the leading edge of the recording medium exiting the eject rollers 115 and 116 is directed toward a path C1 so that the recording medium moves to a temporary storing tray 131 and is accommodated therein. During the conveyance through the path C1, the recording medium is turned over so that the back side of the recording medium faces upward.

Figure 6A:
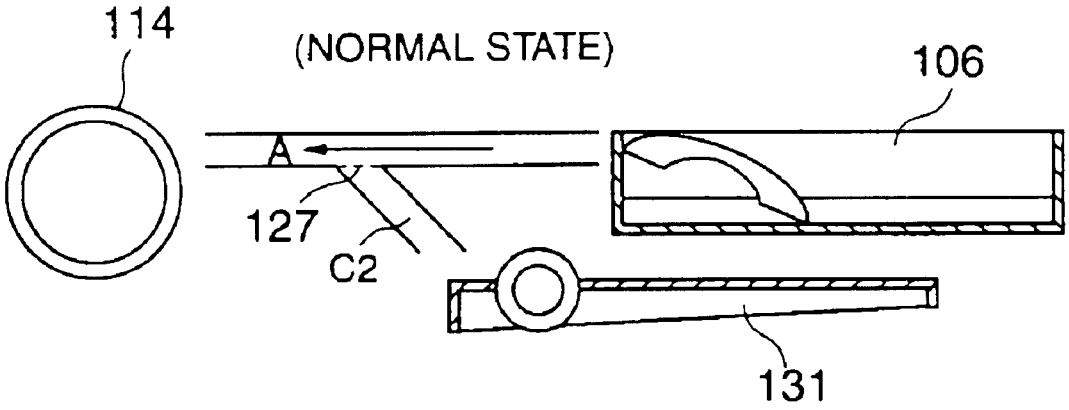
FIGS. 6A and 6B are illustrations for explaining an operation of a switch lever.
Figure 6B:
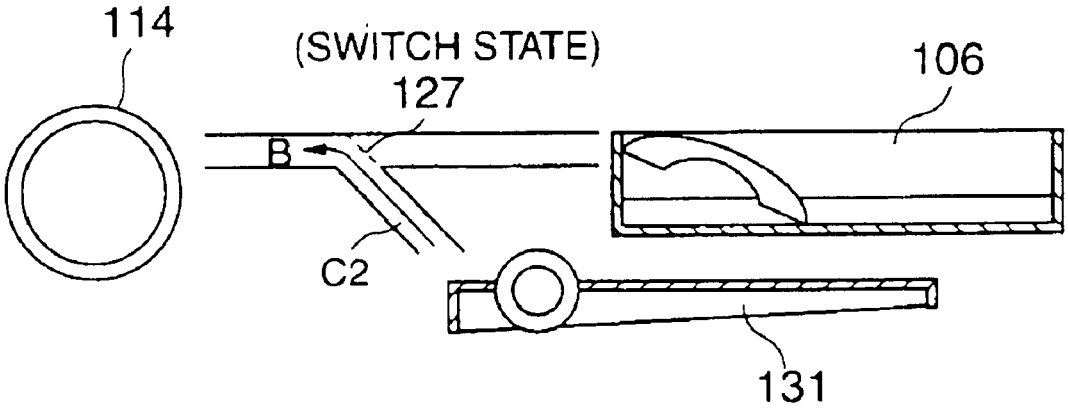
Figure 8A:
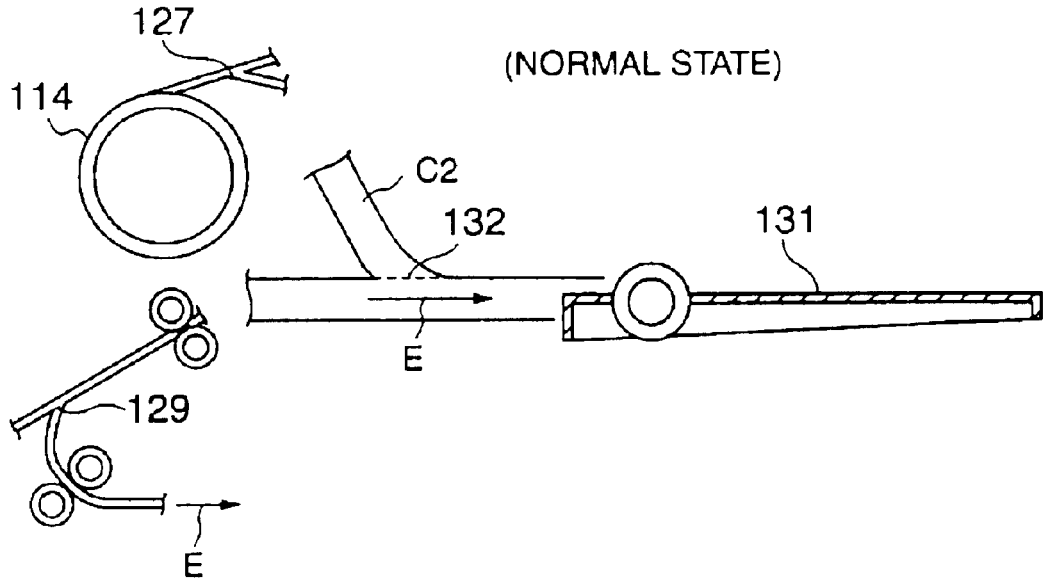
FIGS. 8A and 8B are illustrations for explaining an operation of a switch lever.
Figure 8B:
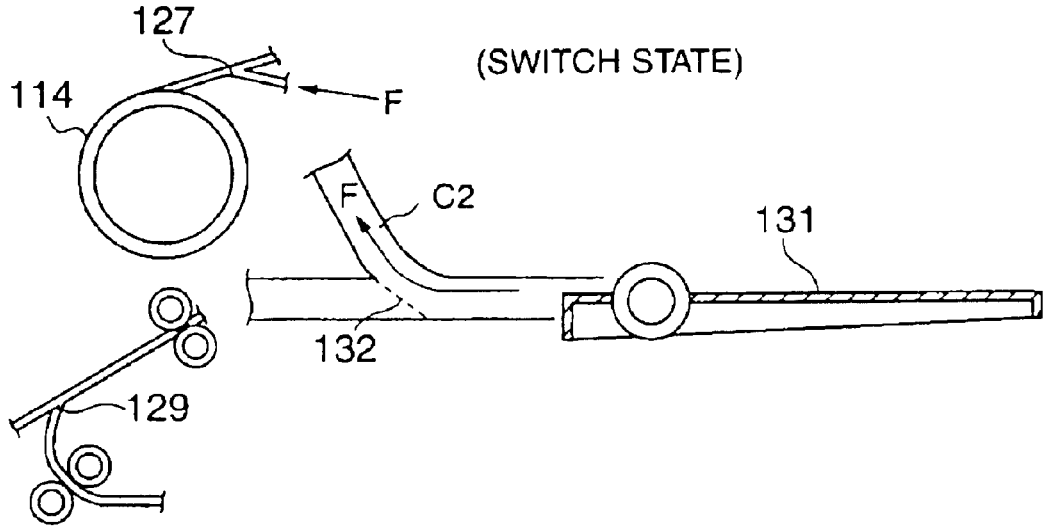

After the recording medium accommodated in the temporary storing tray 131 is detected by a detector 134, the result of detection is supplied to the control unit 140 so as to change each of the switch levers 127 and 132 to the switch state (refer to the switch lever 127 in FIG. 6B and the switch lever 132 in FIG. 8B).

Thereafter, the image forming process to form the image on the layer of the setting agent applied to the intermediate transfer belt 102 is repeated. Then, the recording medium stored in the temporary storing tray 131 is fed toward the transfer roller 114 through a conveyor path C2 within appropriate timing so that the ink image carried by the intermediate transfer belt 102 is transferred onto the back side of the recording medium. Thereafter, the recording medium having images on both sides thereof is ejected to the eject tray 117.

<Third Mode>

In the third mode, which is referred to as both-side mode 2, a new image is formed on the back side of the recording medium whose front side was previously provided with a formed image.

First, it is detected and confirmed by the detector 126 that the front side of the recording medium accommodated in the paper supply tray 106 has a previously formed image. The result of detection is supplied to the control unit 140 so that no new image will be formed on the front side of the recording medium. Then, the recording medium is fed from the paper supply tray 106 by the paper supply rollers 107, 108, 109, 110 and 111 and register rollers 112 and 113. During the feed of the recording medium, the image detector 125 detects whether a previously formed image is present on the back side of the recording medium, and the result of detection is supplied to the control unit 140 so as to change the switch lever 129 to the switch state (refer to the switch lever 129 in FIG. 7B).

In this case, the transfer of an image by the transfer roller 114 onto the front side of the recording medium is not performed as the recording medium passes through the position between the transfer roller 114 and the drive roller 105. Thus, the recording medium enters the path C1, and moves to the temporary storing tray 131 so as to be accommodated therein. During the conveyance through the path C1, the recording medium is turned over so that the back side of the recording medium faces upward. After the recording medium accommodated in the temporary storing tray 131 is detected by the detector 134, the result of detection is supplied to the control unit 140 so as to change each of the switch levers 127 and 132 to the switch state (refer to the switch lever 127 in FIG. 6B and the switch lever 132 in FIG. 8B).

Figure 7A:
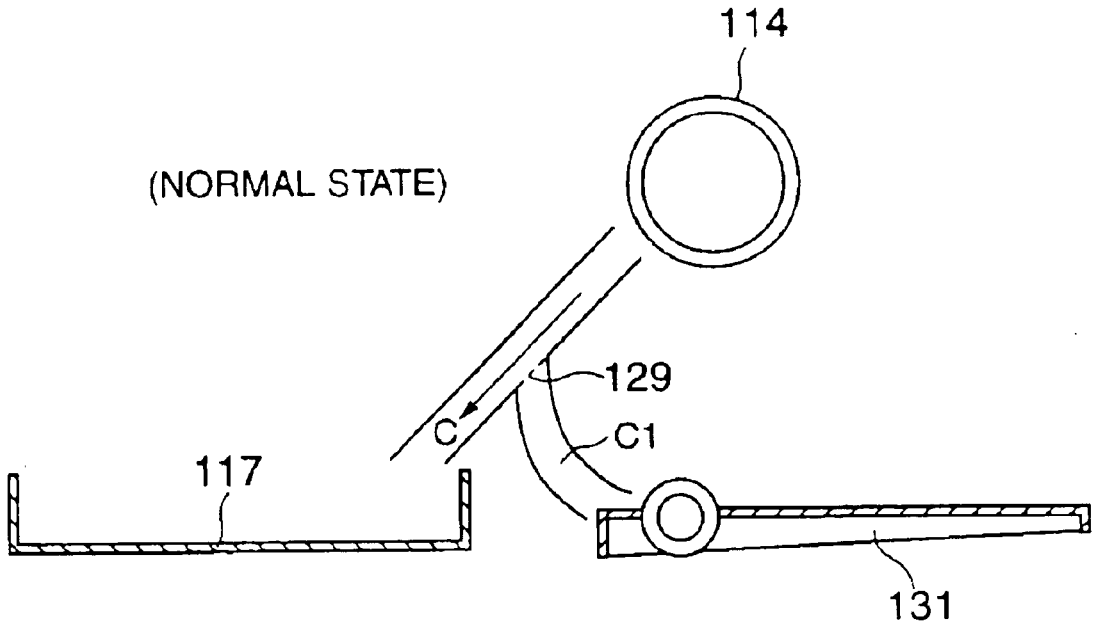
FIGS. 7A and 7B are illustrations for explaining an operation of a switch lever.

The result of detection of the detector 134 is also supplied to the control unit 140, and, thereby, formation of a new image on the intermediate transfer belt 102 is started. Accordingly, ink droplets are projected onto the layer of the setting agent applied to the intermediate transfer belt 102 so as to form an ink image on the layer of the setting agent. The intermediate transfer belt 102 continuously cycles by being engaged with the rollers 103, 104 and 105. Then, the recording medium stored in the temporary storing tray 131 is fed toward the transfer roller 114 through a convey path C2 with appropriate timing so that the ink image carried by the intermediate transfer belt 102 is transferred onto the back side of the recording medium. Thereafter, the recording medium having images on both sides thereof is ejected to the eject tray 117. It should be noted that the switch lever 129 is returned to the normal position as shown in FIG. 7A so as to let the recording medium be directed toward the eject tray 117 after the ink image is transferred onto the back surface of the recording medium.

<Fourth Mode>

In the fourth mode, which is referred to as a both-side mode 3, a new image is formed on the front side of the recording medium whose back side is provided with a previously formed image.

First, it is detected by the detector 126 that the front side of the recording medium accommodated in the paper supply tray 106 does not have a previously formed image. Then, by setting the both-side mode 3, the recording medium is fed from the paper supply tray 106 by the paper supply rollers 107, 108, 109, 110 and 111 and register rollers 112 and 113. During the feed of the recording medium, the image detector 125 detects that a previously formed image is present on the back side of the recording medium. Then, ink droplets are projected by the inkjet recording head 101 onto the layer of the setting agent applied to the intermediate transfer belt 102 so as to form an ink image on the layer of the setting agent. The intermediate transfer belt 102 continuously cycles by being engaged with the rollers 103, 104 and 105. The ink image formed on the intermediate transfer belt 102 and the setting agent corresponding to the ink image are transferred onto the front side of the recording medium by the transfer roller 114. Thereafter, the recording medium having images on both sides thereof is ejected to the eject tray 117 by being fed by the pair of eject rollers 115 and 116.

Figure 2:
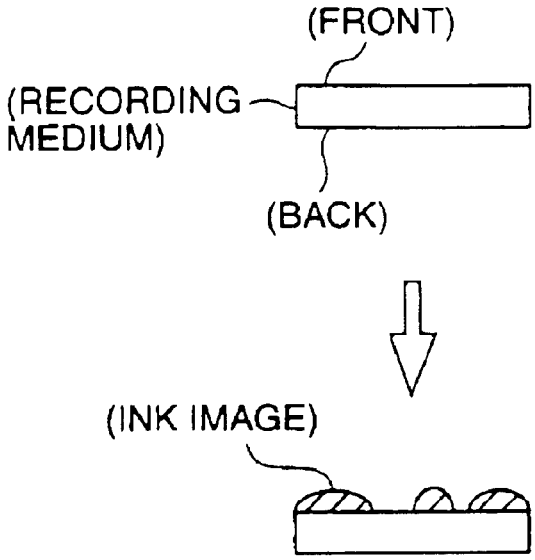
FIG. 2 is a schematic illustration of a recording medium and ink images formed on the recording medium in a single-side mode.

As mentioned above, the inkjet recording apparatus is set in the single-side mode in a case in which both the front side and the back side of the recording medium do not have images, that is, both sides of the recording medium are blank, and an image is to be formed on only the front side of the recording medium as shown in FIG. 2.

Figure 3:
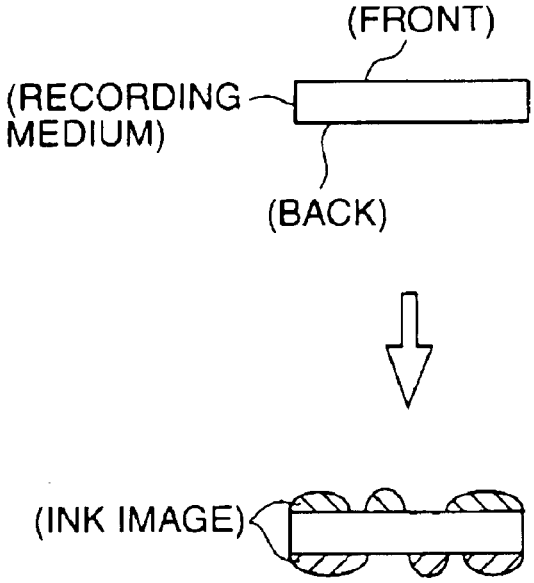
FIG. 3 is a schematic illustration of a recording medium and ink images formed on the recording medium in a both-side mode 1.

The inkjet recording apparatus is set in the both-side mode 1 in a case in which both the front side and the back side of the recording medium do not have images, that is, both sides of the recording medium are blank, and images are to be formed on both sides of the recording medium as shown in FIG. 3.

Figure 4:
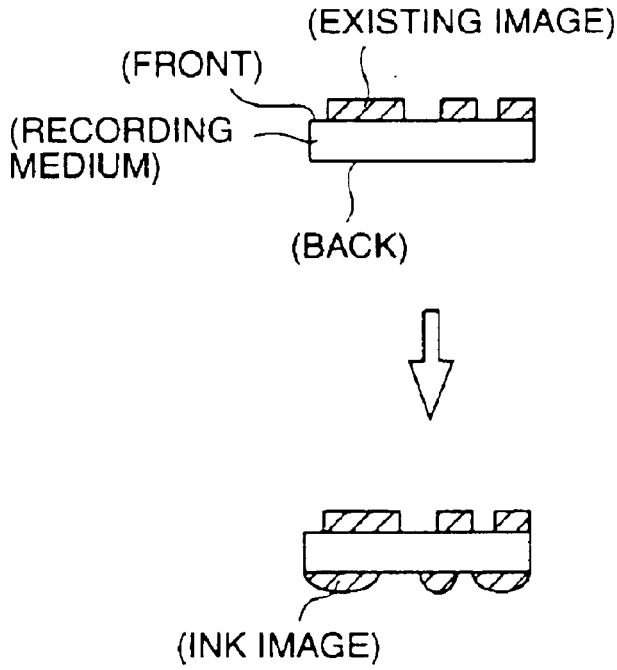
FIG. 4 is a schematic illustration of a recording medium and ink images formed on the recording medium in a both-side mode 2.

Additionally, the inkjet recording apparatus is set in the both-side mode 2 in a case in which the front side of the recording medium already has an image, and an image is to be formed on only the back side of the recording medium as shown in FIG. 4.

Figure 5:
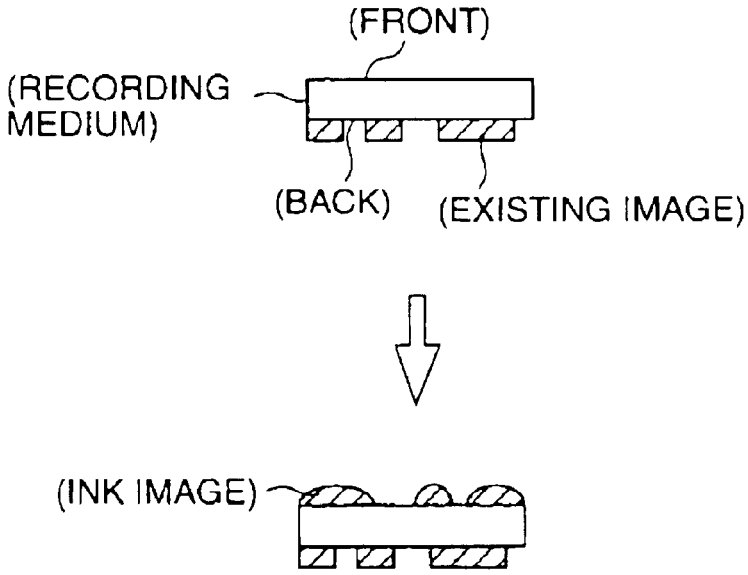
FIG. 5 is a schematic illustration of a recording medium and ink images formed on the recording medium in a both-side mode 3.

Further, the inkjet recording apparatus is set in the both-side mode 3 in a case in which the back side of the recording medium already has an image, and an image is to be formed on only the front side of the recording medium as shown in FIG. 5.

A detailed description will now be given, with reference to FIGS. 6A, 6B, 7A, 7B, 8A and 8B, of the operation of the switch levers 127, 129 and 132.

As mentioned above, the switch levers 127, 129 and 132 are provided for changing the direction of feed of the recording medium based on the operational mode set in the inkjet recording apparatus. Each of the switch levers 127, 129 and 132 is normally set in the normal state, and is placed in the switch state, if necessary, by being controlled by the control unit 140 based on the outputs of the detectors 125, 126 and 134.

Each of the switch levers 127, 129 and 132 which has been placed in the switch state is returned to the normal state immediately after the recording medium passed through the location of the corresponding one of the switch levers 127, 129 and 132.

FIG. 6A shows the switch lever 127 which is in the normal state, and FIG. 6B shows the switch lever 127 which is in the switch state. The switch lever 127 is normally set in the normal state as shown in FIG. 6A so that the recording medium is fed in a direction indicated by an arrow A, that is, in a direction from the paper supply tray to the transfer roller 114. However, when the recording medium accommodated in the temporary storing tray 131 is to be fed in a direction indicated by an arrow B in FIG. 6B, that is, in the direction from the temporary storing tray 131 to the transfer roller 114, the switch lever 127 is placed in the switch state as shown in FIG. 6B by being controlled by the control unit 140 based on the outputs of the detectors 125 and 126.

Figure 7B:
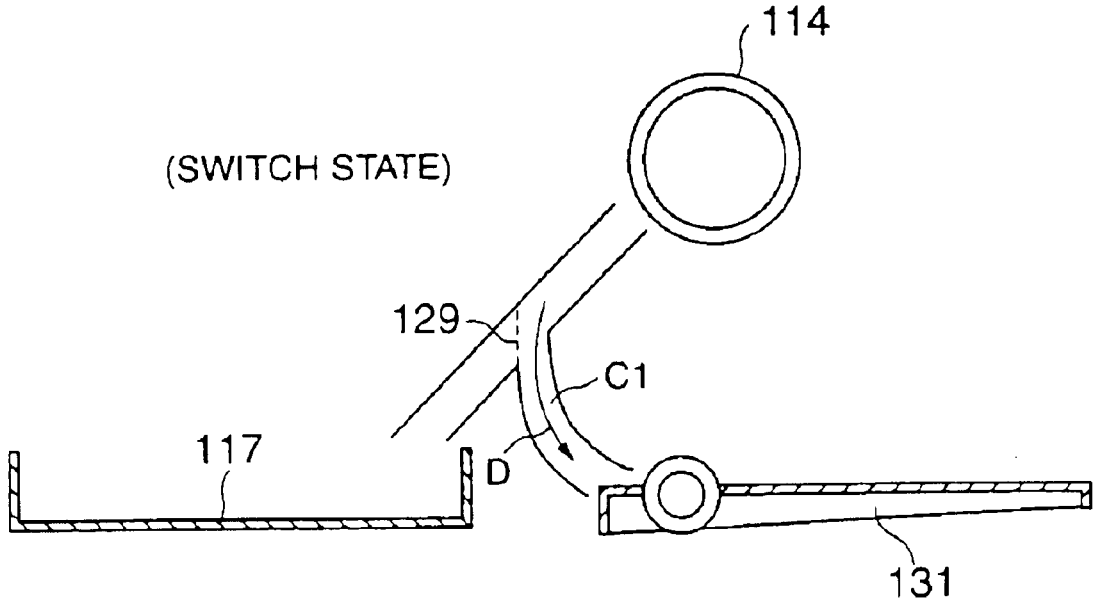

FIG. 7A shows the switch lever 129 which is in the normal state, and FIG. 7B shows the switch lever 129 which is in the switch state. The switch lever 129 is normally set in the normal state as shown in FIG. 7A so that the recording medium is fed in a direction indicated by an arrow C, that is, in a direction from the transfer roller 114 to the eject tray 117. However, when the recording medium is to be fed in a direction indicated by an arrow D in FIG. 7B, that is, in the direction from the transfer roller 114 to the temporary storing tray 131, the switch lever 129 is placed in the switch state as shown in FIG. 7B by being controlled by the control unit 140 based on the outputs of the detectors 125 and 126.

FIG. 8A shows the switch lever 132 which is in the normal state, and FIG. 8B shows the switch lever 132 which is in the switch state. The switch lever 132 is normally set in the normal state as shown in FIG. 8A so that the recording medium is fed in a direction indicated by an arrow E, that is, in a direction from the switch lever 129 to the temporary storing tray 131. However, when the recording medium is to be fed in a direction indicated by an arrow F in FIG. 8B, that is, in the direction from the temporary storing tray 131 to the switch lever 127, the switch lever 132 is placed in the switch state as shown in FIG. 8B by being controlled by the control unit 140 based on the outputs of the detector 134.

As mentioned above, in the inkjet recording apparatus according to the present embodiment, the switch levers 127, 129 and 132 are operated based on the results of detection by the detectors 125, 126 and 134 each of which detects the presence of an image on the front side or the back side of the recording medium. Accordingly, the image recording operations on both sides of the recording medium can be automatically performed by selecting one of the operational modes. Since the presence of an image on both sides of the recording medium is detected by the detectors 125, 126 and 134, the recording medium can be accommodated in the paper supply tray 106 regardless of whether the front surface faces upward or downward. That is, one can place the recording medium in the paper supply tray 106 without considering the side on which an image is to be formed.

It should be noted that the recording medium recorded by the inkjet recording apparatus according to the present invention does not experience running ink or penetration of ink since the ink image is formed according to the recording method using the setting agent applied to the intermediate transfer belt, thereby allowing high quality ink images to be formed on both sides of the recording medium.

A description will now be given of the results of experiments conducted to compare the image quality of the image formed by the recording method using the setting agent of the present invention with the image quality of the image formed by a conventional recording method.

<Comparison Test 1>

Carbopole ETD2020 (manufactured by Nikko Chemicals Co., Ltd.) and Carbopole ETD2050 (manufactured by Nikko Chemicals Co., Ltd.) were mixed by a weight ratio of 3:1 by using a commercially available powder mixer. Two pieces of silicon rubber plate were prepared, and the mixture of powders was applied to a surface of each of the first and second silicon rubber plates. An ink image was formed on the mixture of powders on the first silicon rubber plate by an inkjet recording apparatus using a commercially available water based ink. Immediately after the formation of the ink image, the ink image and the corresponding mixture of powders were transferred onto a sheet of unused regular paper (commercially available PPC copy paper). Immediately after the transfer of the ink image formed on the first silicon rubber plate, an ink image was formed on the mixture of powders on the second silicon rubber plate by an inkjet recording apparatus using a commercially available water based ink. The ink image formed on the second silicon rubber plate and the corresponding mixture of powders were transferred onto the back side of the sheet of regular paper whose front side the ink image formed on the first silicon rubber plate had been transferred. There was no running or penetration of ink observed on both the front side and the back side of the regular paper. The resolution of the ink images on both sides of the regular paper was excellent. There was no problem in transferring the ink images from the silicon rubber plates to the regular paper.

On the other hand, an ink image was formed directly on the front side of another sheet of the same regular paper (commercially available PPC copy paper) by the same inkjet recording apparatus using the same water based ink. Immediately after the formation of the ink image on the front side of the regular paper, another ink image was formed directly on the back side of the regular paper by the same inkjet recording apparatus using the same water based ink. There were running ink and ink penetration on both sides of the regular paper, and the ink image on one side of the regular paper was superimposed on the ink image on the other side of the regular paper. The resolution of the images on both sides was low.

<Comparison Test 2>

Carbopole ETD2020 (manufactured by Nikko Chemicals Co., Ltd.) and Carbopole ETD2050 (manufactured by Nikko Chemicals Co., Ltd.) were mixed by a weight ratio of 3:1 by using a commercially available powder mixer. A silicon rubber plate was prepared, and the mixture of powders was applied to a surface of the silicon rubber plate. An ink image was formed on the mixture of powders on the silicon rubber plate by an inkjet recording apparatus using a commercially available water based ink. Immediately after the formation of the ink image, the ink image and the corresponding mixture of powders were transferred onto the back side of a sheet of regular paper (commercially available PPC copy paper) whose front side was previously provided with an image formed by a commercially available PPC copy machine. There was no running or penetration of ink observed on the front side and the back side of the regular paper. The resolution of the ink images on both sides of the regular paper was excellent. There was no problem in transferring the ink image from the silicon rubber plate to the regular paper.

On the other hand, an ink image was formed on the back side of another sheet of the same regular paper (commercially available PPC copy paper) by the same inkjet recording apparatus using the same water based ink, the front side of the sheet of regular paper having an image previously formed by the same PPC copy machine. There were running and penetration of ink observed on both sides of the sheet of regular paper, and the ink image on the back side of the regular paper was superimposed on the image on the front side of the regular paper. The resolution of the ink image on the back side was low.

The present invention is not limited to the specifically disclosed embodiments, and variations and modifications may be made without departing from the scope of the present invention.

The present application is based on Japanese priority patent application No. 11-080508 filed on Mar. 24, 1999, the entire contents of which are hereby incorporated by reference.

What is claimed is:

1. A method for recording images on a sheet-like recording medium having a first side and a second side opposite to the first side, the method comprising the steps of:

forming a layer of a material on an intermediate transfer member;

applying a liquid to the layer formed on the intermediate transfer member so as to form a first visible image on the layer, a viscosity of the liquid being increased by the material forming the layer on the intermediate transfer member;

transferring the first visible image onto the first side of the recording medium;

forming another layer of the material on the intermediate transfer member:

applying the liquid to the layer formed on the intermediate transfer member so as to form a second visible image on the layer; and transferring the second visible image onto the second side of the recording medium.

2. The method as claimed in claim 1, wherein the material forming the layer on the intermediate transfer member has a liquid absorbing property, and the material is in the form of powder.

3. The method as claimed in claim 2, wherein the material is a mixture of a plurality of kinds of powders.

4. A recording apparatus recording images on a sheet-like recording medium having a first side and a second side opposite to the first side, the recording apparatus comprising:

means for forming a layer of a material, on an intermediate transfer member;

means for applying a liquid to the layer formed on the intermediate transfer member so as to form a visible image on the layer, a viscosity of the liquid being increased by the material forming the layer on the intermediate transfer member;

means for transferring the visible image onto one of the first and second sides of the recording medium;

means for turning over the recording medium after the visible image is transferred onto the one of the first and second sides of the recording medium; and means for repeating operations of means for forming, means for applying and means for transferring so as to transfer the visible image onto the other one of the first and second sides of the recording medium.

5. The recording apparatus as claimed in claim 4, wherein the material forming the layer on the intermediate transfer member has a liquid absorbing property, and the material is in the form of powder.

6. The recording apparatus as claimed in claim 5, wherein the material is a mixture of a plurality of kinds of powders.

* * * * *